US007246931B2

(12) United States Patent
Hsieh et al.

(10) Patent No.: US 7,246,931 B2
(45) Date of Patent: Jul. 24, 2007

(54) LED LIGHT SOURCE

(75) Inventors: Min-Hsun Hsieh, Hsinchu (TW); Chou-Chih Yin, Hsinchu (TW); Chia-Liang Hsu, Hsinchu (TW); Jen-Shui Wang, Hsinchu (TW); Chia-Fen Tsai, Hsinchu (TW); Chien-Yuan Wang, Hsinchu (TW)

(73) Assignee: Epistar Corporation, Hsinchu (TW)

( * ) Notice: Subject to any disclaimer, the term of this patent is extended or adjusted under 35 U.S.C. 154(b) by 0 days.

(21) Appl. No.: 11/302,732

(22) Filed: Dec. 13, 2005

(65) Prior Publication Data

US 2006/0126343 A1 Jun. 15, 2006

(30) Foreign Application Priority Data

Dec. 15, 2004 (TW) ..... 93139034 A

(51) Int. Cl.
*F21V 7/04* (2006.01)

(52) U.S. Cl. ..... 362/612; 362/327; 362/355; 362/326; 362/555

(58) Field of Classification Search ..... 362/612, 362/327, 555; 313/512
See application file for complete search history.

(56) References Cited

U.S. PATENT DOCUMENTS 6,536,923 B1 * 3/2003 Merz ..... 362/327
6,547,423 B2 * 4/2003 Marshall et al. ..... 362/333
6,612,720 B1 * 9/2003 Beadle ..... 362/287
6,974,241 B2 * 12/2005 Hara et al. ..... 362/606
6,981,784 B2 * 1/2006 Dubuc ..... 362/331
7,135,034 B2 * 11/2006 Friedman et al. ..... 607/88
7,159,997 B2 * 1/2007 Reo et al. ..... 362/240
2004/0218388 A1 * 11/2004 Suzuki ..... 362/231
2005/0002205 A1 * 1/2005 Yu et al. ..... 362/555
2005/0270774 A1 * 12/2005 Pan ..... 362/217
2005/0286251 A1 * 12/2005 Smith ..... 362/327
2006/0087866 A1 * 4/2006 Ng et al. ..... 362/612

* cited by examiner

*Primary Examiner*—Renee Luebke
*Assistant Examiner*—Evan Dzierzynski
(74) *Attorney, Agent, or Firm*—J.C. Patents

(57) ABSTRACT

A tube type light emitting diode light source including a light source generator, a light guide and a diffuser is provided. The light source generator includes LEDs arranging in a line. The light guide has a grooved light incident surface and a grooved light-guiding surface. The grooved light incident surface encompasses the LEDs, and the grooved light-guiding surface is adapted for changing the propagating direction of an incident light. The diffuser covers the light guide.

18 Claims, 10 Drawing Sheets

LED LIGHT SOURCE

CROSS-REFERENCE TO RELATED APPLICATION

This application claims the priority benefit of Taiwan application serial no. 93139034, filed on Dec. 15, 2004. All disclosure of the Taiwan application is incorporated herein by reference.

BACKGROUND OF THE INVENTION

1. Technical Field

The present invention generally relates to a light emitting diode (LED) light source and, in particular, to a tube type LED light source.

2. Description of the Related Art

A liquid crystal display (LCD) is a non-self luminescent flat panel display which includes a flat light source device. The flat light source device is a so-called backlight module. There are two types of backlight modules: direct-light type and edge-light type backlight modules. A conventional direct-light type backlight module comprises a plurality of light tubes (such as cold cathode fluorescent lamps), a diffuser sheet, a prism sheet, and so on. Light generated from the light tubes is reflected back or partially absorbed when travelling through the diffuser sheet, and therefore the transmittance of light is reduced. Besides, the performance of the cold cathode fluorescent lamps is unstable and will cause the backlight module to have a dark region if any of the cold cathode fluorescent lamps is failed. Moreover, it can be understood from FIG. 1 that the illumination provided by the backlight module is un-uniform and the smaller the distance between the diffuser 102 and the corresponding cold cathode fluorescent lamps 101 is, the more un-uniform the illumination provided by the backlight module is.

To scatter the light uniformly to serve as a light source for LCD devices, the distance between every light source should be controlled precisely, and the distance between the light sources and the diffuser or the prism sheet should be increased, and then the thickness of the backlight module is increased accordingly to avoid uneven brightness distribution.

SUMMARY

Accordingly, an object of the present invention is to provide a tube type LED light source to make the brightness of light generated from the light source more uniform.

Another purpose of the present invention is to provide a backlight module of a flat panel display having a thinner thickness.

As embodied and broadly described herein, the present invention provides a tube type LED light source comprising a light source generator, a light guide and a diffuser. The light source generator comprises a plurality of LEDs arranging in a line. The light guide is covered by the diffuser and has a grooved light incident surface and a grooved light-guiding surface. The grooved light incident surface encompasses the LEDs, and the grooved light-guiding surface is for changing the propagating direction of an incident light.

According to one embodiment of the present invention, a cross-section of the grooved light incident surface is circular, elliptic or polygonal.

According to one embodiment of the present invention, a groove of the grooved light-guiding surface is parallel with the LEDs lines.

According to one embodiment of the present invention, a groove of the grooved light-guiding surface has a V-shaped, U-shaped or wavy cross-section.

According to one embodiment of the present invention, the LEDs are formed on a base.

According to one embodiment of the present invention, the tube type LED light source further comprises a reflection layer disposed between the LEDs and the base.

According to one embodiment of the present invention, the reflection layer comprises a metal layer or a mirror.

According to one embodiment of the present invention, the tube type LED light source further comprises a radiator disposed outside the light source generator for heat dissipation.

According to one embodiment of the present invention, the cross-section of the diffuser is circular, elliptic or polygonal.

According to one embodiment of the present invention, the diffuser further comprises a distributed pattern disposed on a light incident surface thereof, and an incident light generated from the light source generator is mixed by the reflection and/or refraction through the distributed pattern.

According to one embodiment of the present invention, the diffuser further comprises a Moiré lens disposed on a light incident surface thereof, and an incident light generated from the light source generator is mixed by the reflection and/or refraction through the Moiré lens.

According to one embodiment of the present invention, the light generated from the light source generator comprises white light, red light, blue light or green light.

According to one embodiment of the present invention, the light source generator generates white light.

According to one embodiment of the present invention, the white light is generated from a white light LED, or is generated by mixing lights of different colors generated from a plurality of LEDs of different colors.

According to one embodiment of the present invention, the material of the light guide is selected from one of the group consisting of acrylic resin, COC, PMMA, PC, polyetherimide, fluorocarbon polymer and silicone.

According to one embodiment of the present invention, the material of the diffuser is selected from one of the group consisting of acrylic resin, COC, PMMA, PC, polyetherimide, fluorocarbon polymer and silicone.

According to one embodiment of the present invention, the grooved light incident surface has a groove of strip type.

According to one embodiment of the present invention, the grooved light incident surface has a plurality of concave openings.

As embodied and broadly described herein, the present invention also provides a backlight module of a flat panel display comprising a plurality of tube type LED light sources and a prism sheet The components of each tube type LED light source have been discussed, and it is not repeated herein. The prism sheet is disposed on the tube type LED light sources.

In summary, after the light generated from the light source generator is incident into the light incident surface of the light guide, the light is refracted and its propagating direction is changed through the V-shape grooved light guiding surface. The light emitted from the light guide travels through the diffuser, to make the brightness of light surrounding the LED light source more even. Thus, the problem of uneven brightness of the light source can be resolved.

Furthermore, when the tube type LED light source is applied to a backlight module of LCD devices, there is no need to add a light guiding plate, and therefore the thickness of the backlight module is reduced. Accordingly, the problems of complicated fabrication process, higher cost and thicker thickness of the conventional backlight module can be improved.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 4 is a cross-sectional view showing a flat panel display, which the tube type LED light source is applied to.

DESCRIPTION OF THE EMBODIMENTS

Figure 1:
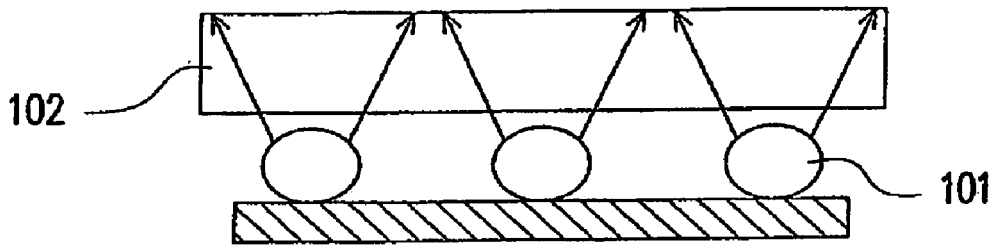
FIG. 1 (PRIOR ART)
FIG. 1 is a schematic view showing a conventional backlight module when light generated from a cold cathode fluorescent lamp travels through a diffuser sheet.

Reference will now be made in detail to the present preferred embodiments of the invention, examples of which are illustrated in the accompanying drawings. Wherever possible, the same reference numbers are used in the drawings and the description to refer to the same or like parts.

Figure 2A:
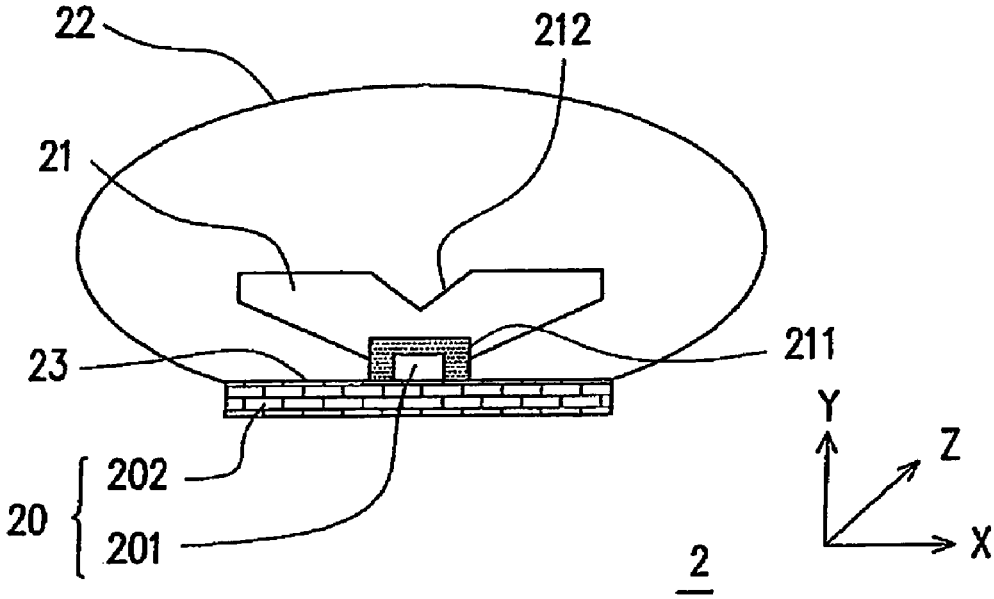
FIG. 2A is a cross-sectional view showing the tube type LED light source of the present invention along the x-axis.
Figure 2B:
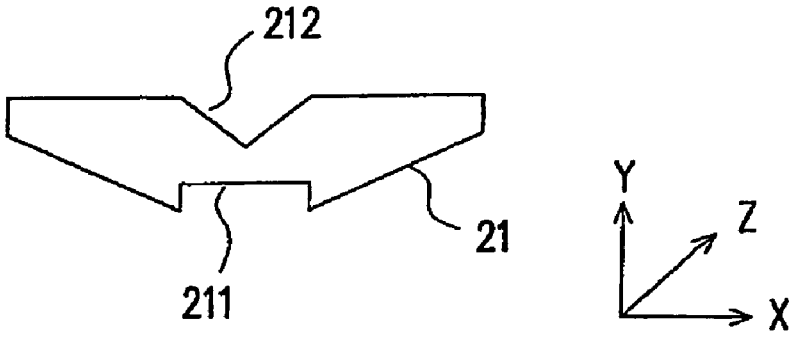
FIG. 2B is a cross-sectional view showing a light guide of the tube type LED light source of the present invention along the x-axis.
Figure 2C:
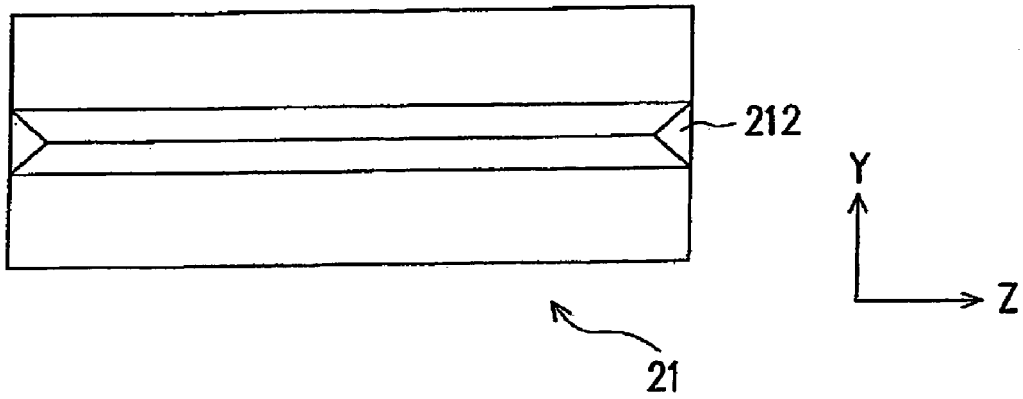
FIG. 2C is a top view showing a light guide of the tube type LED light source of the present invention.
Figure 2D:
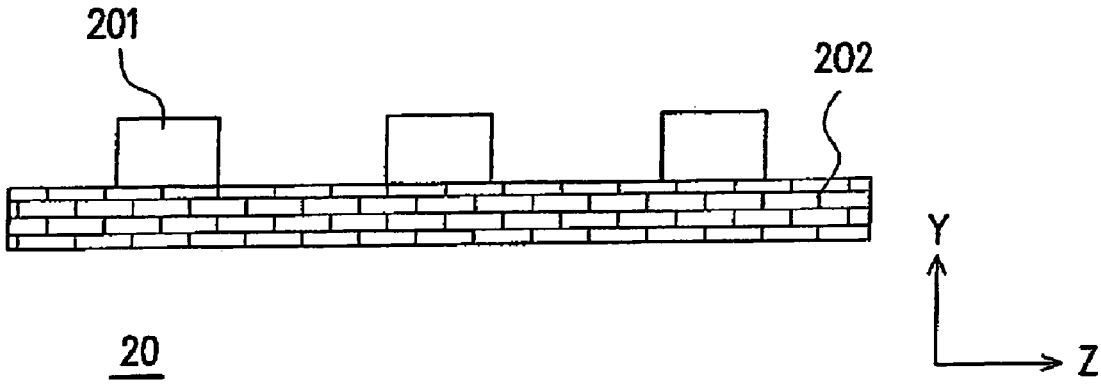
FIG. 2D is a cross-sectional view showing the tube type LED light source of the present invention along the z-axis.

FIG. 2A is a cross-sectional view showing the tube type LED light source of the present invention along the x-axis. FIG. 2B is a cross-sectional view showing a light guide of the tube type LED light source of the present invention along the x-axis. FIG. 2C is a top view showing a light guide of the tube type LED light source of the present invention. FIG. 2D is a cross-sectional view showing a light source generator of the tube type LED light source of the present invention along the z-axis. Please refer to FIGS. 2A and 2D, the tube type LED light source 2 mainly comprises a light source generator 20, a light guide 21 and a diffuser 22. The light source generator 20 comprises a plurality of LEDs 201 arranging in a line on a base 202. The light guide 21 has a grooved light incident surface 211 and a grooved light-guiding surface 212. The grooved light incident surface 211 encompasses the LEDs 201, and the grooved light-guiding surface 212 is adapted for changing the propagating direction of an incident light. The diffuser 22 covers the light guide 21. Besides, a reflection layer 23 is selectively disposed between the LEDs 201 and the base 202, such that the incident light of the base 202 can be reflected to the light source generator 20. In one embodiment of the present invention, the reflection layer comprises a metal layer, a mirror, other devices or surface with treatments for reflecting light. Please refer to FIGS. 2B and 2C, the cross-section of the grooved light incident surface 211 of the light guide 21 is circular, elliptic or polygonal, and the grooved light-guiding surface 212 has a V-shaped, U-shaped or wavy cross-section. In this preferred embodiment, the grooved light-guiding surface 212 has a V-shaped cross-section. When the light generated from the light source generator 20 penetrates through the light guide 21, a total internal reflection (TIR) occurs at a specific angle because a loose medium (such as gas) is disposed at the other side of the groove. For example, if the groove has a V-shaped cross-section with an included angle $\theta$, and the critical angle of material of the light guide is $\theta c$, a TIR occurs at the angle when $\theta<2\times(90-\theta c)$. Similarly, if the groove has a U-shaped or wavy cross-section, a TIR occurs at a specific angle to scatter the light. After the light travels through the light guide 21 and passes through the diffuser 22, the light distribution surrounding the LEDs 201 will become uniform.

Figure 3A:
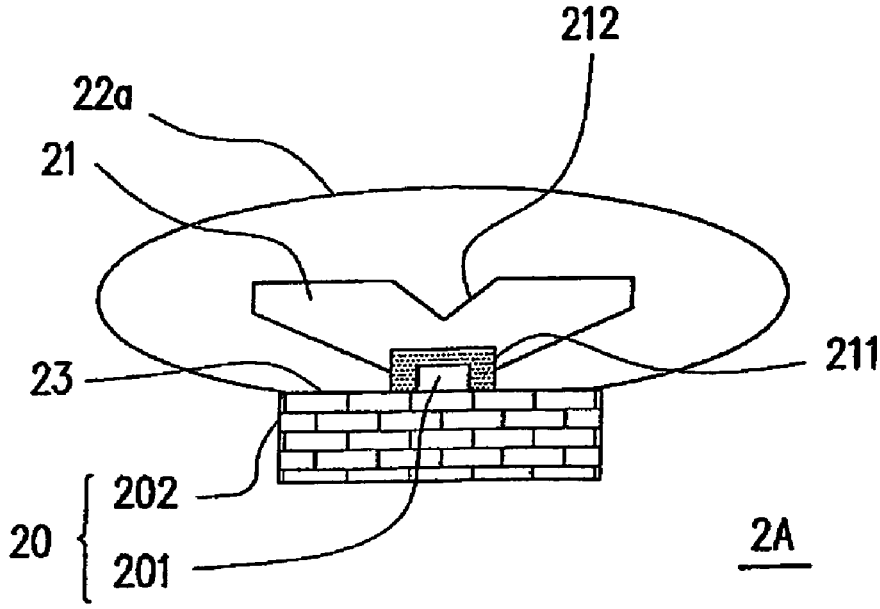
FIGS. 3A and 3B are cross-sectional views showing the tube type LED light source with different diffusers.
Figure 3B:
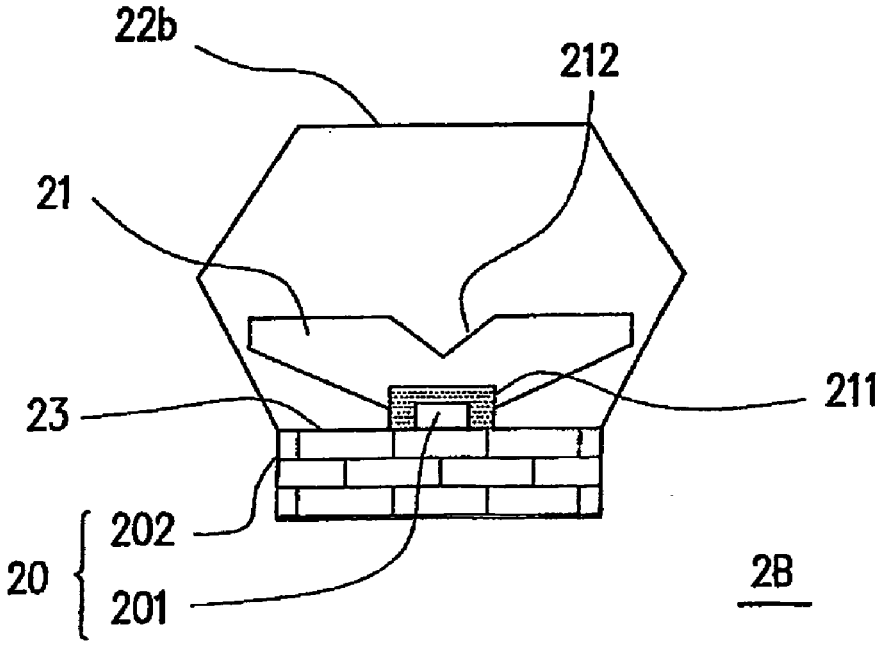

FIGS. 3A and 3B are cross-sectional views showing the tube type LED light source with different diffusers. Referring to FIGS. 3A and 3B, the structure of the tube type LED light source 2A and 2B are similar to that of the tube type LED light source 2 as shown in FIG. 2A, and the difference between them is that the cross-section of the diffuser 22*a* and 22*b* as shown in FIGS. 3A and 3B are elliptic and polygonal, respectively. The shape of the cross-section of the diffuser is not limited in the present invention.

The above-mentioned tube type LED light source can be applied to a large-sized flat panel display. A plurality of tube type LED light sources can be assembled together to form an array for the large-sized flat panel display. Please refer to FIG. 4, five tube type LED light sources 1*a*, 1*b*, 1*c*, 1*d* and 1*e* are disposed in a flat panel display. When the LED light sources 1*a*, 1*b*, 1*c*, 1*d* and 1*e* are turned on, the brightness of nine different positions at the flat panel display are measured respectively. The average brightness of the nine positions is 11,393 nits, the largest brightness is 12,520 nits, the smallest brightness is 10,820 nits, and the uniformity of the brightness is 86.42%. When only the LED light sources 1*a*, 1*c* and 1*d* are turned on, the brightness of nine different positions at the flat panel display are measured respectively. The average brightness of the nine positions is 7,271 nits, the largest brightness is 7,927 nits, the smallest brightness is 6,870 nits, and the uniformity of the brightness is 86.67%. Accordingly, when the tube type LED light sources are applied to the backlight module, even if one of the light sources is out of order, the brightness will be lower, but the uniformity can still remain the same. Therefore, the problem of uneven brightness in the conventional backlight module is resolved. Besides, referring to FIG. 5, a prism sheet 24 may be selectively placed on the tube type LED light sources 1*a*, 1*b*, 1*c*, 1*d* and 1*e*.

Figure 6A:
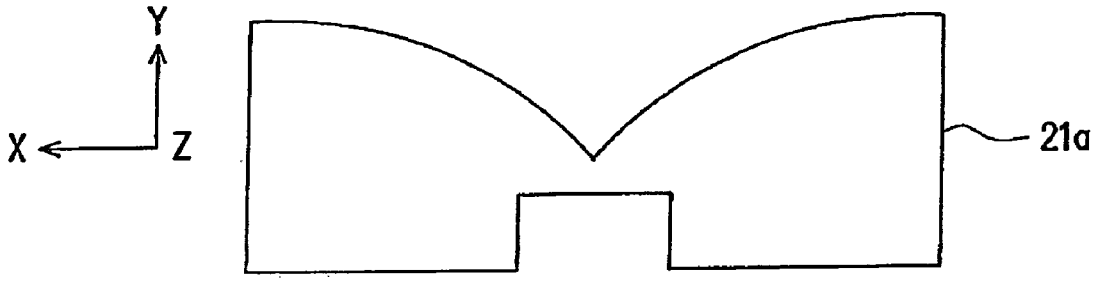
FIG. 6A is a cross-sectional view showing a light guide of the tube type LED light source of the present invention along the x-axis.
Figure 6B:
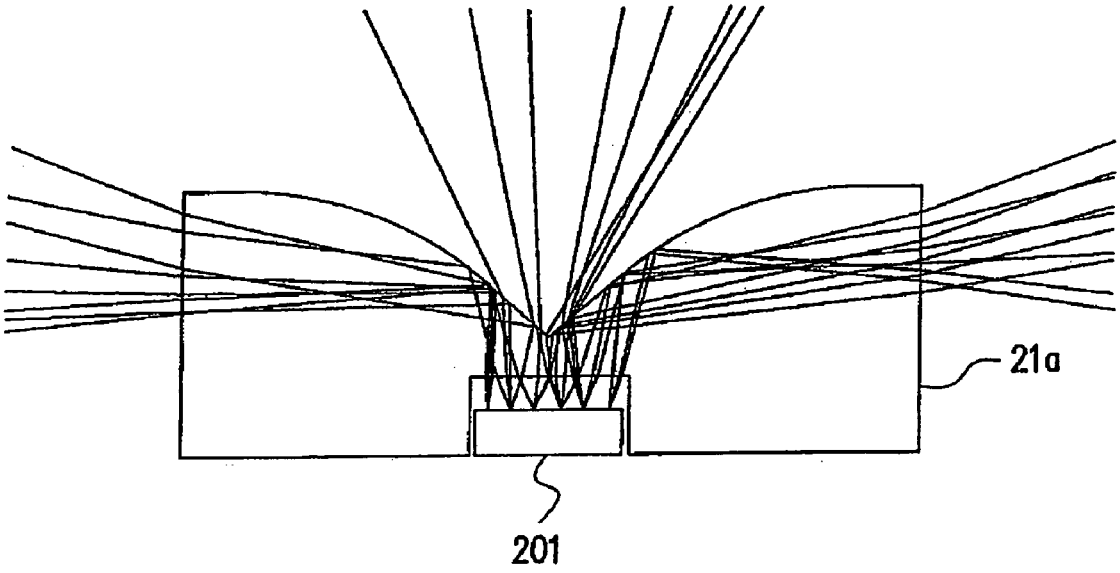
FIG. 6B is a simulation diagram of the propagating of light in the light guide of the tube type LED light source of the present invention.
Figure 7A:
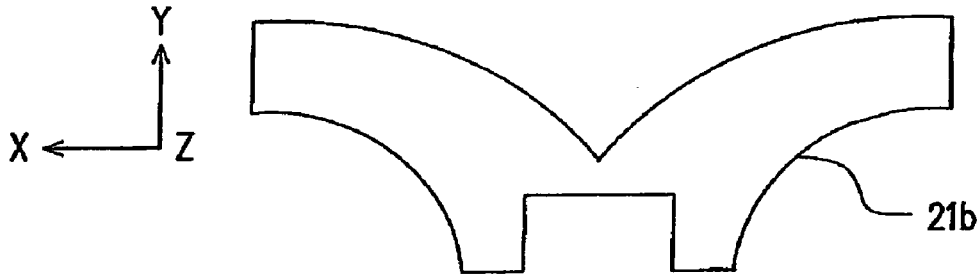
FIG. 7A is a cross-sectional view showing a light guide of the tube type LED light source of the present invention along the x-axis.
Figure 7B:
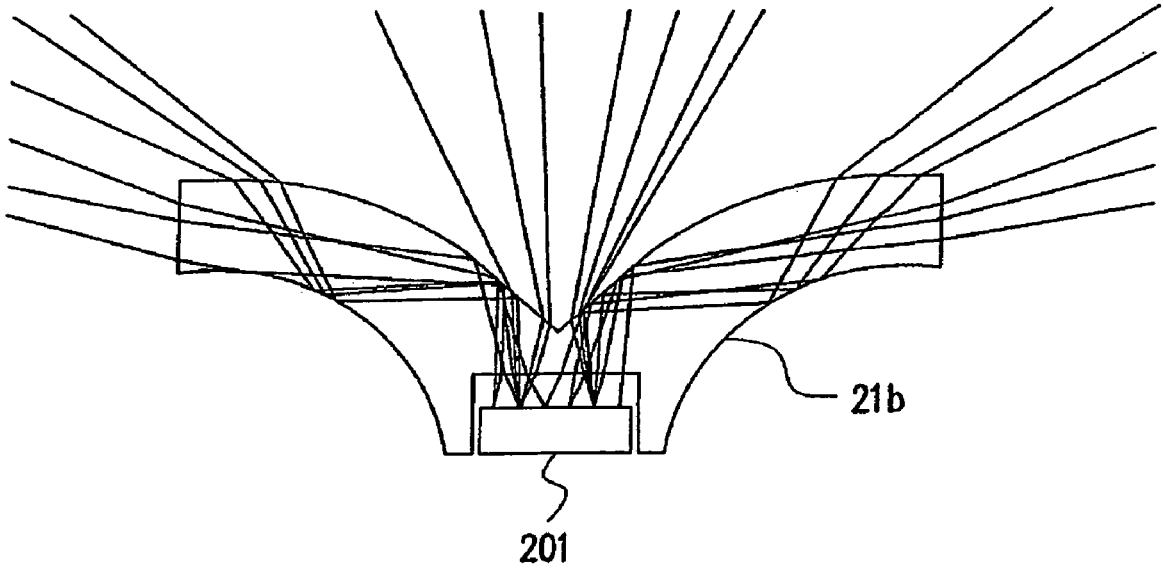
FIG. 7B is a simulation diagram of the propagating of light in the light guide of the tube type LED light source of the present invention.

FIG. 6A is a cross-sectional view showing a light guide of the tube type LED light source of the present invention along the x-axis. FIG. 6B is a simulation diagram of the propagating of light in the light guide of the tube type LED light source of the present invention. FIG. 7A is a cross-sectional view showing a light guide of the tube type LED light source of the present invention along the x-axis. FIG. 7B is a simulation diagram of the propagating of light in the light guide of the tube type LED light source of the present invention. As shown in FIG. 6B, after the light generated from the LED 201 travels through the light guide 21*a*, the light is scattered toward the left side and the right side of the light guide 21*a* and the center of the V-shaped groove. Similarly, please refer to FIG. 7B, after the light generated from the LED 201 travels through the light guide 21*b*, it is scattered evenly along the light guide 21*b*. Therefore, light distribution can be adjusted according to the design of the light guide in the present invention.

In the present invention, light generated from the light source generator 20 comprises white light, red light, blue light or green light. If white light is needed, it can be generated from a white light LED, or by mixing lights of different colors generated from a plurality of LEDs of different colors.

Figure 8A:
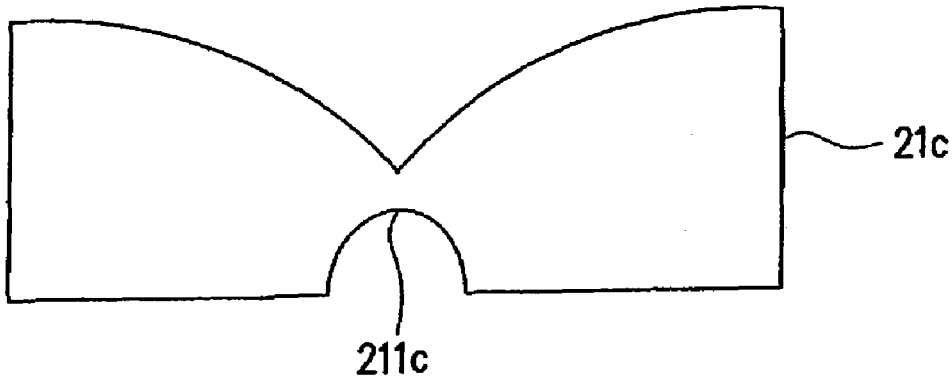
FIGS. 8A to 8C are cross-sectional views showing the light guide with different light incident surfaces.
Figure 8B:
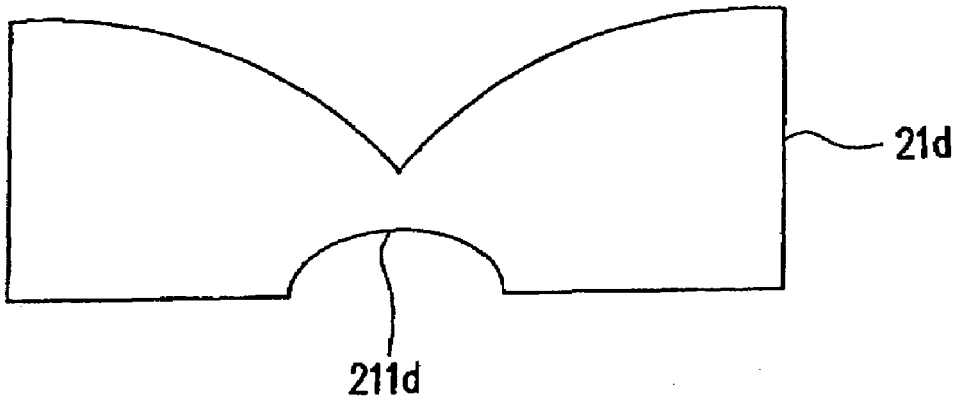
Figure 8C:
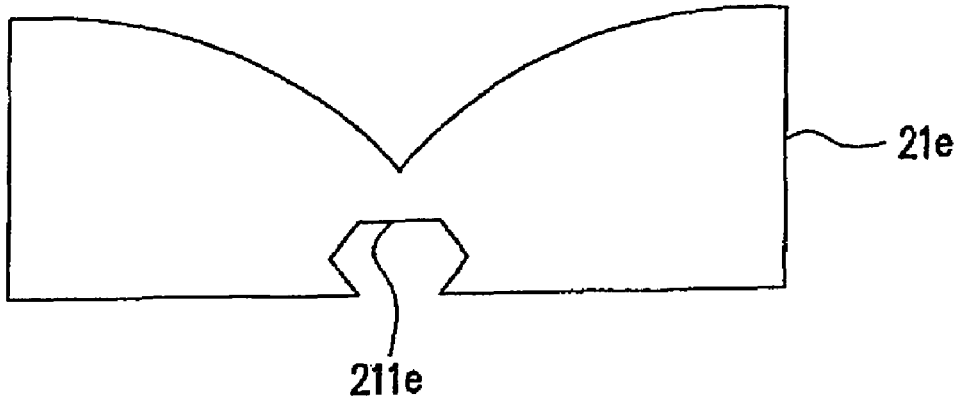
Figure 9A:
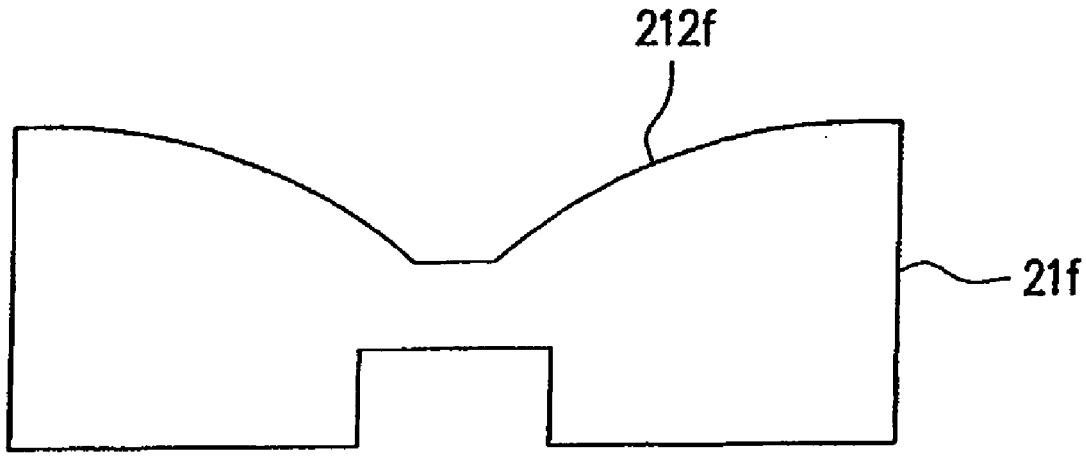
FIGS. 9A and 9B are cross-sectional views showing the light guide with different grooved light-guiding surface.
Figure 9B:
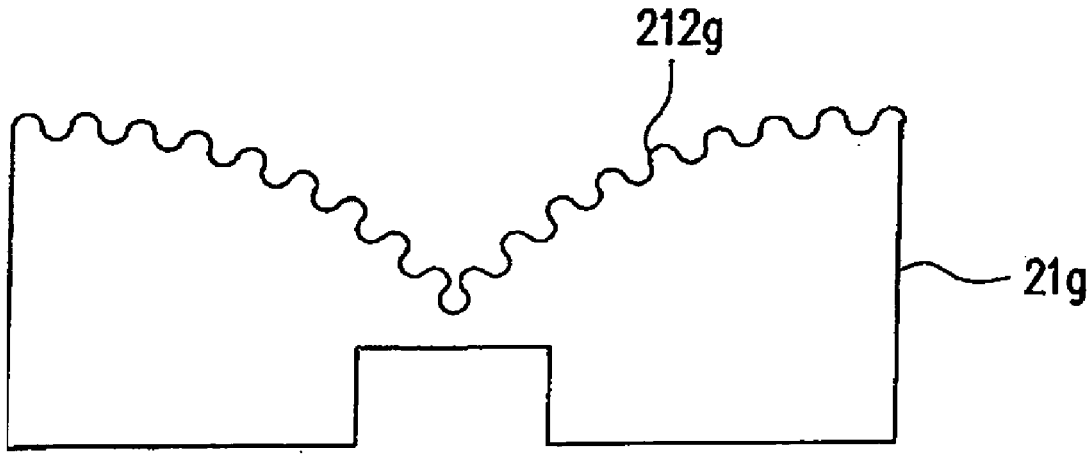

In the above-mentioned light guide 21, the grooved light incident surface 211 has a groove of strip type. Besides, the groove of strip type can be replaced by a plurality of concave openings. FIGS. 8A to 8C are cross-sectional views showing the light guide with different light incident surfaces. As shown in FIGS. 8A to 8C, the light guides 21*c*, 21*d* and 21*e* have a circular, elliptic or polygonal light incident surface 211*c*, 211*d* and 211*e*, respectively. FIGS. 9A and 9B are cross-sectional views showing the light guide with different grooved light-guiding surface. As shown in FIGS. 9A and 9B, the light guide 21*f* and 21*g* have a U-shaped and wavy shaped grooved light-guiding surface 212*f* and 212*g*, respectively. The shape of the light incident surface and the grooved light-guiding surface of the light guide is not limited in the present invention.

Figure 4:
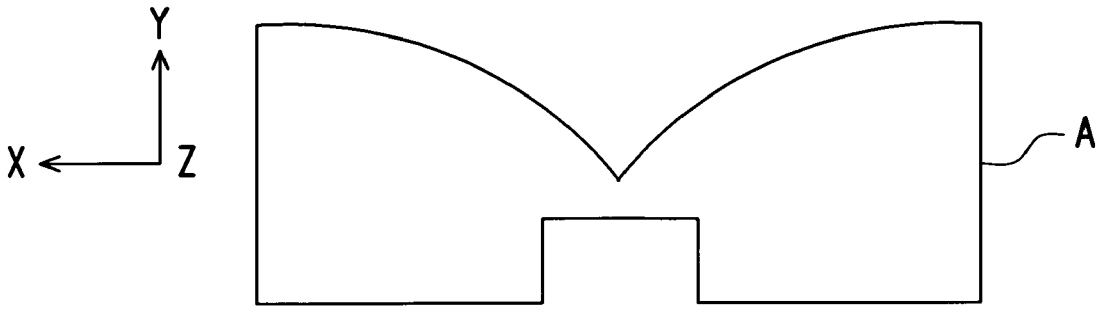
Figure 5:
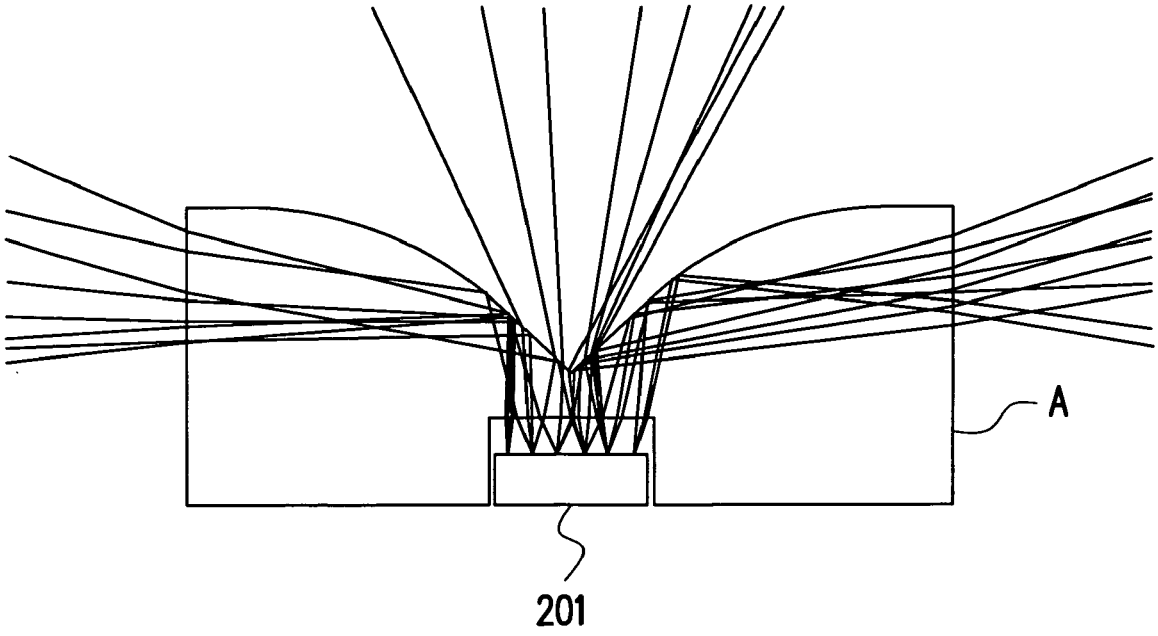
FIG. 5 is a cross-sectional view showing the flat panel display as shown in FIG. 4 with a prism sheet.
Figure 10:
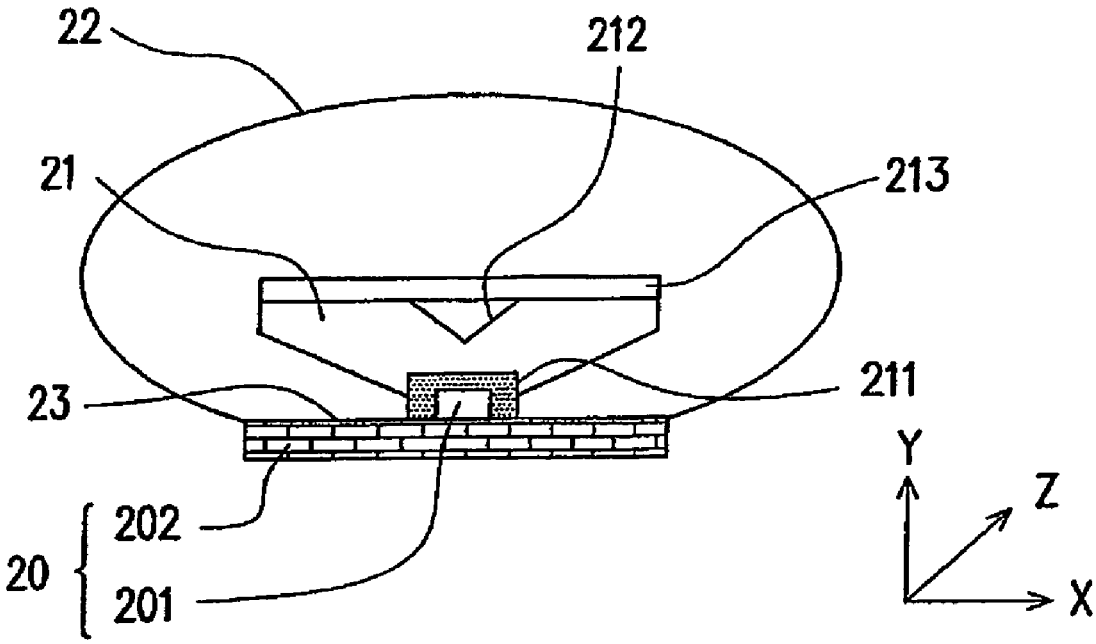
FIG. 10 is a cross-sectional view showing the tube type LED light source according to another embodiment of the present invention.
Figure 11:
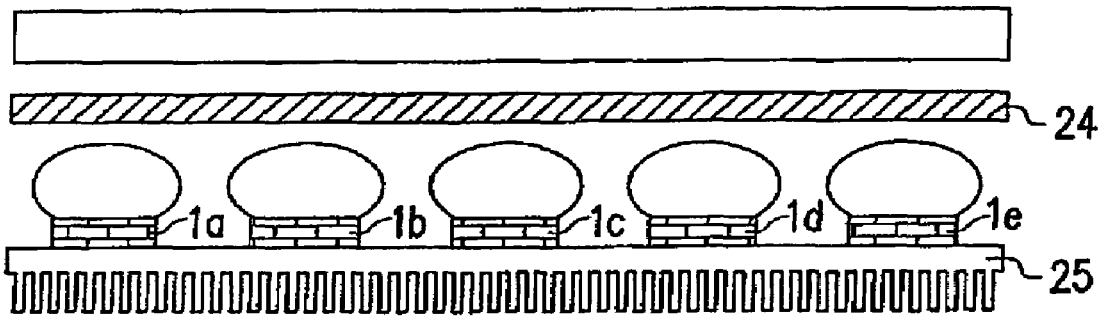
FIG. 11 is a cross-sectional view showing the flat panel display as shown in FIG. 4 with a radiator.

FIG. 10 is a cross-sectional view showing the tube type LED light source according to another embodiment of the present invention. Referring to FIG. 10, the diffuser 22 further comprises a Moiré lens 213 disposed on a light incident surface thereof, and an incident light generated from the light source generator 20 is mixed by the reflection and/or refraction through the Moiré lens 213. FIG. 11 is a cross-sectional view showing the flat panel display as shown in FIG. 4 with a radiator. Referring to FIG. 11, the flat panel display shown in FIG. 4 may further comprises a radiator 25 attached to the tube type LED light sources 1*a*, 1*b*, 1*e*, 1*d* and 1*e* for heat dissipation.

In one embodiment of the present invention, the material of the light guide 21 is selected from one of the group consisting of acrylic resin, COC, PMMA, PC, polyetherimide, fluorocarbon polymer and silicone.

The above-mentioned diffuser 22 may further comprise a printed distributed pattern disposed on a light incident surface 211 thereof, and an incident light generated from the light source generator 20 is mixed by the reflection and/or refraction through the distributed pattern. Besides, the printed distributed pattern can be replaced by a Moiré lens to achieve the same purpose.

The cross-section of the above-mentioned diffuser 22 is circular, elliptic or polygonal, and the material thereof is selected from one of the group consisting of acrylic resin, COC, PMMA, PC, polyetherimide, fluorocarbon polymer and silicone.

In summary, the present invention utilizes the arrangement of the light guide and the diffuser to change the propagating direction of light. Thus, the brightness of light surrounding the LED light source becomes more even, and the problem of uneven brightness of the light source can be resolved. Besides, when the tube type LED light source is applied to a backlight module of LCD devices, there is no need to add a light guiding plate, and the total thickness of the backlight module is reduced. As a result, the problems of complicated fabrication process, higher cost and thicker thickness of the conventional backlight module can be resolved.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A tube type light emitting diode light source, comprising:

a light source generator comprising a plurality of LEDs in a strip;

a strip type light guide having a grooved light incident surface and a grooved light-guiding surface and substantially covering the light source generator; and a strip type diffuser encapsulating the strip type light guide and the LEDs.

2. The tube type light emitting diode light source according to claim 1, wherein a cross-section of the grooved light incident surface is circular, elliptic or polygonal.

3. The tube type light emitting diode light source according to claim 1, wherein a groove of the grooved light-guiding surface is aligned with said plurality of LEDs.

4. The tube type light emitting diode light source according to claim 1, wherein the grooved light-guiding surface has a V-shaped, U-shaped, or wavy cross-section.

5. The tube type light emitting diode light source according to claim 1, wherein said plurality of LEDs are formed on a base.

6. The tube type light emitting diode light source according to claim 5, further comprising a reflection layer disposed between said plurality of LEDs and the base.

7. The tube type light emitting diode light source according to claim 6, wherein the reflection layer comprises a metal layer or a mirror.

8. The tube type light emitting diode light source according to claim 1, further comprising a radiator disposed outside the light source generator for heat dissipation.

9. The tube type light emitting diode light source according to claim 1, wherein the cross-section of the diffuser is circular, elliptic or polygonal.

10. The tube type light emitting diode light source according to claim 1, wherein the diffuser further comprises a distributed pattern on a light incident surface thereof, and an incident light generated from the light source generator is mixed by the reflection and/or refraction through the distributed pattern.

11. The tube type light emitting diode light source according to claim 1, wherein the diffuser further comprises a Moiré lens disposed on a light incident surface thereof, and an incident light generated from the light source generator is mixed by the reflection and/or refraction through the Moiré lens.

12. The tube type light emitting diode light source according to claim 1, wherein the light generated from the light source generator comprises white light, red light, blue light or green light.

13. The tube type light emitting diode light source according to claim 12, wherein the white light is generated from a white light LED, or is generated by mixing lights of different colors generated from a plurality of LEDs of different colors.

14. The tube type light emitting diode light source according to claim 1, wherein the light guide comprises at least one material selected from the group consisting of acrylic resin, COC, PMMA, PC, polyetherimide, fluorocarbon polymer, and silicone.

15. The tube type light emitting diode light source according to claim 1, wherein the diffuser comprises at least one material selected from the group consisting of acrylic resin, COC, PMMA, PC, polyetherimide, fluorocarbon polymer, and silicone.

16. The tube type light emitting diode light source according to claim 1, wherein the grooved light incident surface has a groove of strip type.

17. The tube type light emitting diode light source according to claim 1, wherein the grooved light incident surface has a plurality of concave openings.

18. A backlight module of a flat panel display, comprising:

a plurality of tube type LED light sources, wherein each tube type LED light source comprises:

a light source generator comprising a plurality of LEDs in a strip;

a strip type light guide having a grooved light incident surface and a grooved light-guiding surface and substantially covering the light source generator; and a strip type diffuser encapsulating the strip type light guide and the LEDs; and a prism sheet on said plurality of tube type LED light sources.

* * * * *